US010994885B2

(12) United States Patent
Kraft et al.

(10) Patent No.: US 10,994,885 B2
(45) Date of Patent: May 4, 2021

(54) LABELING APPARATUS

(71) Applicant: Bizerba SE & Co. KG, Balingen (DE)

(72) Inventors: Martin Kraft, Dautmergen (DE); Kevin Weckenmann, Schoemberg (DE); Florian Struecker, Geislingen (DE)

(73) Assignee: Bizerba SE & Co. KG, Balingen (DE)

( * ) Notice: Subject to any disclaimer, the term of this patent is extended or adjusted under 35 U.S.C. 154(b) by 68 days.

(21) Appl. No.: 16/359,203

(22) Filed: Mar. 20, 2019

(65) Prior Publication Data

US 2019/0291912 A1 Sep. 26, 2019

(30) Foreign Application Priority Data

Mar. 21, 2018 (EP) ..... 18163141

(51) Int. Cl.
*B65C 1/02* (2006.01)
*B65C 9/00* (2006.01)
*B65C 9/42* (2006.01)

(52) U.S. Cl.
CPC ..... *B65C 1/02* (2013.01); *B65C 9/00* (2013.01); *B65C 9/42* (2013.01)

(58) Field of Classification Search
CPC .. B65C 1/02; B65C 1/021; B65C 9/00; B65C 9/42; B65G 2203/0058
See application file for complete search history.

(56) References Cited

FOREIGN PATENT DOCUMENTS

| | | | |
|---|---|---|---|
| DE | 10 2013 203 456 | A1 | 8/2014 |
| GB | 2 075 549 | A | 12/1981 |
| GB | 2 253 829 | A | 9/1992 |
| WO | 93/08081 | A1 | 4/1993 |

OTHER PUBLICATIONS

Translation of DE102013203456A1, Aug. 28, 2014, Bizerba GMGH (Year: 2014).*
European Search Report dated Oct. 10, 2018 of corresponding European Patent Application No. 18163141.7 (nine pages).

* cited by examiner

*Primary Examiner* — George R Koch
(74) *Attorney, Agent, or Firm* — Kilpatrick Townsend & Stockton LLP

(57) ABSTRACT

The invention relates to a labeling apparatus having a conveyor belt for transporting packages, having a labeler to apply labels to the packages from below, and having a pullout apparatus that comprises a pullout that is supported via a pullout guide at a stationary pullout carrier and that is linearly travelable relative thereto between a retracted end position and an extended end position, wherein the labeler is positioned on the pullout, and wherein the pullout apparatus is configured such that the location of the retracted end position of the pullout is adjustable. The pullout apparatus comprises a motor-driven adjustment unit to set the location of the retracted end position of the pullout.

20 Claims, 6 Drawing Sheets

LABELING APPARATUS

Figure 1:
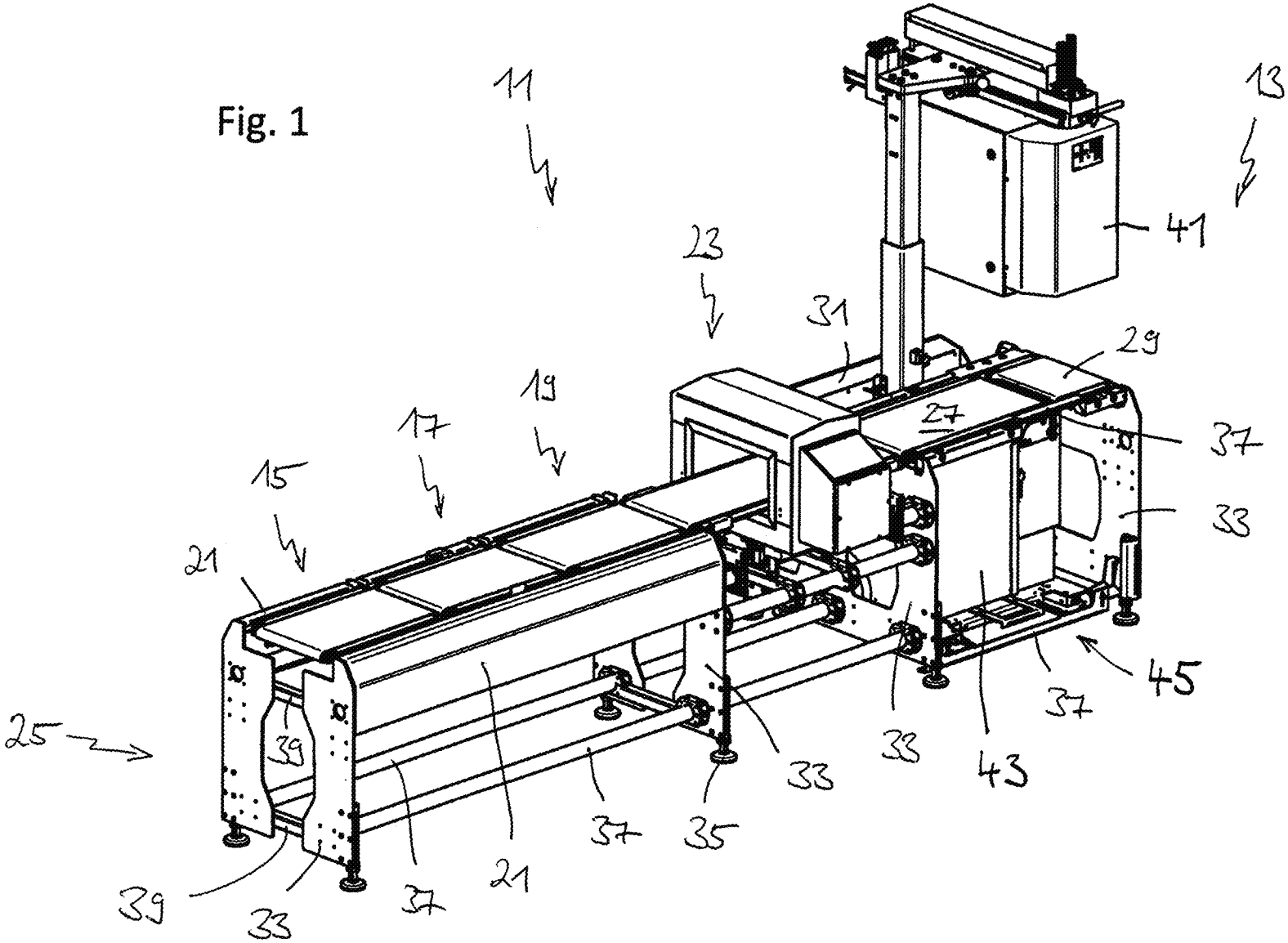

This application claims priority to European Patent Application No. 18163141.7, filed Mar. 21, 2018, the disclosure of which is incorporated by reference herein.

The present invention relates to a labeling apparatus having a conveyor belt for transporting packages, in particular along a transport direction, having a labeler, in particular for the lower side of the package, to apply labels to the packages from below, and having a pullout apparatus that comprises a pullout that is supported via a pullout guide at a stationary pullout carrier and that is linearly travelable relative thereto between a retracted end position and an extended end position, in particular transversely, in particular perpendicular, to the direction of conveying, wherein the labeler is positioned on the pullout, and wherein the pullout apparatus is configured such that the location of the retracted end position of the pullout is adjustable, in particular in the direction of travel.

Such a labeling apparatus is known from document DE 10 2013 203 456 A1. Labelers without a pullout are only accessible with difficulty for the lower package side due to their arrangement beneath the conveyor belt so that the operation and maintenance of such labelers is made more difficult. Due to the pullout, however, the labeler can be brought or moved out of its operating position beneath the conveyor belt into a more easily accessible service position without any greater problems. The traveling of the pullout takes place manually and is made possible by the pullout guide.

The label position on the packages to be labeled can furthermore be set via the location of the retracted end position that corresponds to the operating position of the labeler. For example, the location of the retracted end position can be adjusted to change from a central application position of the labels on the packages to an off-center attachment position. Furthermore as a rule, an adaptation of the location of the labeler will also be required on a conversion of the labeling apparatus to labels and/or packages of different widths.

To set the location of the retracted end position and thus of the labeler, a stopper for the pullout is provided in the direction of travel in document DE 10 2013 203 456 A1. The stopper is upwardly oriented and is fastened to a rail that is adjustable in the direction of travel via screw connections along elongate holes formed in a cross member of the pullout carrier, with the rail being clamped to the cross member with tightened screw connections. Furthermore, a downwardly directed abutment element that contacts the stopper in the retracted end position is non-adjustably fastened to the end of the pullout trailing on the retraction.

In the labeling apparatus of the document DE 10 2013 203 456 A1, the labeler is accordingly admittedly simply and comfortably accessible per se, but not the device to set the location of the retracted end position of the pullout so that the operation of this setting device is made more difficult.

It is the underlying object of the invention to provide a labeling apparatus of the initially named kind that enables a less problematic setting of the location of the retracted end position of the pullout.

The object is satisfied by a labeling apparatus having the features of claim 1 and in particular in that the pullout apparatus comprises a motor-driven adjustment unit, in particular an electric motor drive, in particular controlled by a control device, to set the location of the retracted end position of the pullout.

In accordance with the invention, it is therefore not the accessibility to a setting device such as is known from the prior art that is improved, but a completely different approach is rather selected, that is providing a motor-driven adjustment unit to set the location of the pullout in the retracted end position. Accessibility for an operator is not necessary at all here.

The pullout guide and the pullout carrier are each part of the pullout apparatus. The pullout is in particular travelable horizontally and/or at least substantially perpendicular to a direction of transport of the conveyor belt. The labeler is in particular arranged beneath the conveyor belt and/or within a rack of the labeling apparatus. The motor-driven adjustment unit is in particular not adapted to travel the pullout into the extended end position. A traveling of the pullout beyond the end positions is in particular not possible, in particular in normal operation of the labeling apparatus. The packages can in particular be outer packaging.

A control device is in particular provided that is configured to control the motor-driven adjustment unit of the pullout apparatus such that the location of the retracted end position of the pullout relative to the conveyor belt is set, in particular automatically, in dependence on a predefined dispensing position of the labels to be applied.

The dispensing position can, for example, be predefined by a corresponding input. Additionally or alternatively, however, a storage device can also be provided in which a plurality of dispensing positions for labels and/or packages of different dimensions, in particular widths, are stored, with the control unit being adapted to select the predefined dispensing position from the stored dispensing positions.

In accordance with an embodiment, the motor-driven adjustment unit comprises a threaded spindle, in particular having a threaded rod and a spindle nut, and an electric motor driving the threaded spindle. Such a motor-driven adjustment unit can be simply implemented and permits an exact setting of the location of the retracted end position of the pullout. The pitch of the threaded spindle is typically selected as comparatively small to permit a fine setting of the location of the retracted end position. A traveling of the pullout between the retracted end position and the extended end position can in contrast take place on the basis of a corresponding traveling of the spindle nut. The electric motor can in particular be fixedly arranged on the pullout so that it is traveled with the pullout on a setting of the location of the retracted end position and on a traveling between the retracted end position and the extended end position. The same applies to a housing of the motor-driven adjustment unit.

The pullout is preferably axially fixedly coupled to the threaded rod, in particular via a housing of the motor-driven adjustment unit, so that an axial movement of the threaded rod and thus of the pullout takes place with a fixedly held spindle nut and with an activated electric motor. If therefore the electric motor is switched on so that the threaded rod rotates and if the spindle nut is simultaneously held in a fixed manner, a movement of the threaded rod in its axial direction necessarily results herefrom. Since the pullout is axially fixedly connected to the threaded rod, an axial movement of the threaded rod necessarily results in a corresponding movement of the pullout.

A security against retraction can be provided in this respect that releases the axially fixed coupling of the pullout to the threaded rod when a force acting on the pullout and acting against the retraction exceeds a predefined amount on an automated retraction from the extended position into the retracted position, in particular due to a corresponding traveling of the spindle nut. This can be the case, for example, when an arm or a hand of an operator is accidentally squeezed between the pullout and a rack of the labeling apparatus on a retraction of the pullout. Injuries to the operator can be at least largely avoided by the security against retraction.

The security against retraction can be implemented in a simple and safe manner in that the threaded rod is admittedly rotationally fixedly coupled to the electric motor, but is axially movable, with the threaded rod actuating a safety switch against the force of a spring on an exceeding of the predefined amount. An automatic retraction, in particular on the basis of a further drive such as is explained in more detail in the following, can be switched off by the safety switch.

As mentioned above, the pullout apparatus can comprise a further drive, in particular controlled by a control device, to travel the pullout between the retracted end position and the extended end position in an automated manner, i.e. not manually. The further drive is preferably formed as a pneumatic cylinder or as a hydraulic cylinder, in particular having a fixedly arranged housing and a piston arranged axially movably therein. The operating pressure of the pneumatic cylinder here preferably amounts to a maximum of 3 bar, in particular to a maximum of 2 bar. At these, comparatively low, pressures, injuries to the operator due to squeezing on a retraction of the pullout can likewise be at least largely avoided. The aforesaid spindle nut can in particular be axially fixedly coupled to the piston so that an axial movement of the motor-driven adjustment unit and thus of the pullout takes place with an activated further drive. The provision of the further drive in particular permits a fast traveling of the pullout between the retracted end position and the extended end position, whereas the traveling of the pullout takes place comparatively slowly on the setting of the location of the retracted end position by the motor-driven adjustment unit, in particular by a correspondingly small pitch of the aforesaid threaded spindle, to enable a fine adjustment of this location. The traveling of the pullout between the retracted end position and the extended end position in particular takes place at a higher speed than the traveling of the pullout on the setting of the location of the retracted end position. It is generally also possible that the pullout is alternatively or additionally configured as a manual pullout to manually travel the pullout between the retracted end position and the extended end position.

Furthermore, a security against extension can be provided that releases the axially fixed coupling of the spindle nut to the piston when a force acting on the pullout and acting against the extension exceeds a predefined amount on an extension from the retracted end position into the extended end position, in particular on the basis of a corresponding traveling of the piston. This can, for example, be the case when an operator is in the way of an extension of the pullout. Injuries to the operator can be at least largely avoided by the security against extension.

The security against extension can be implemented in a simple and safe manner in that the coupling of the spindle nut to the piston comprises a magnetic coupling between a magnet and an entrainer, with the magnetic coupling releasing on an exceeding of the predefined amount.

The conveyor belt in particular comprises two conveyor belt sections that are arranged behind one another, in particular in the direction of transport, and spaced apart from one another so that a gap through which the labels can be applied to the packages from below is formed between the two conveyor belt sections. The gap in particular extends over the total width of the conveyor belt so that particularly wide labels can also be applied and/or labels can be applied to the packages at any point.

The invention further relates to a weighing conveying apparatus having at least one conveyor belt, a weighing belt, and a labeling apparatus such as has been described above.

Further advantageous embodiments of the invention are described in the dependent claims, in the further description and in the drawing.

Figure 2:
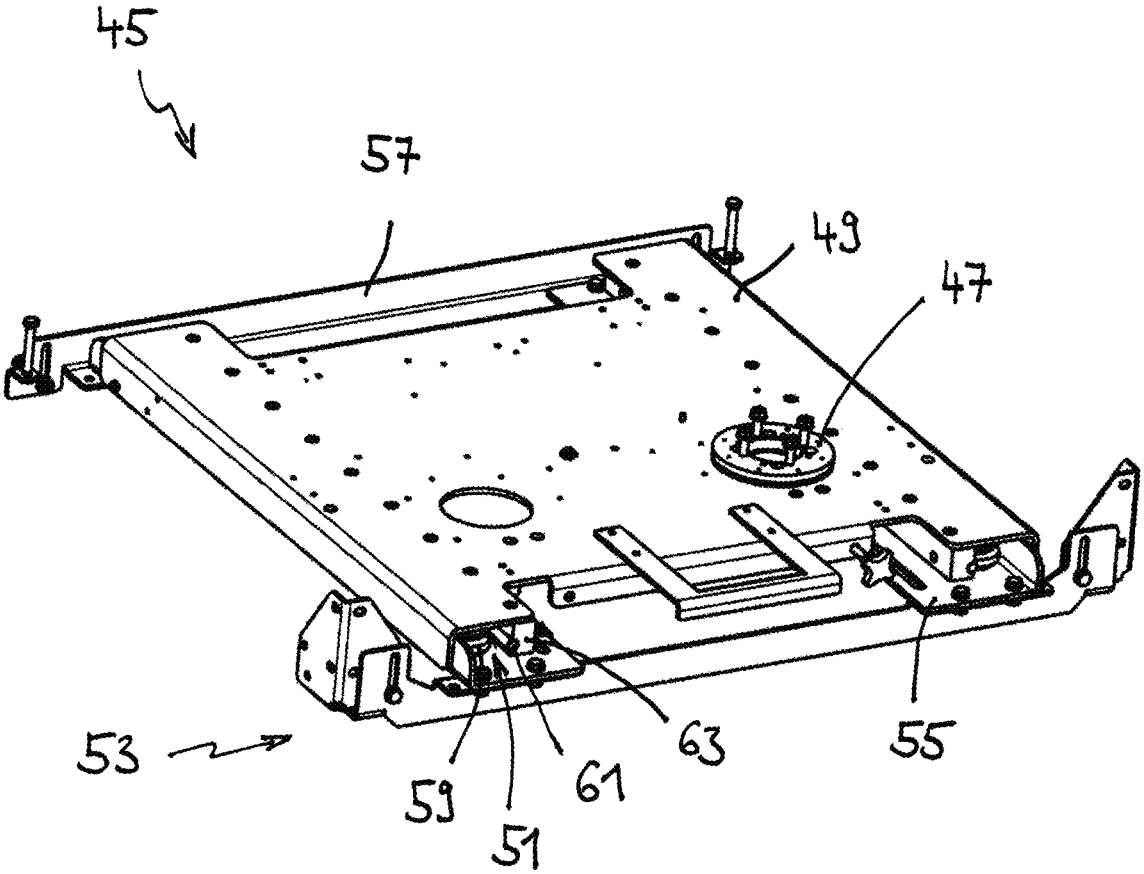
Figure 3:
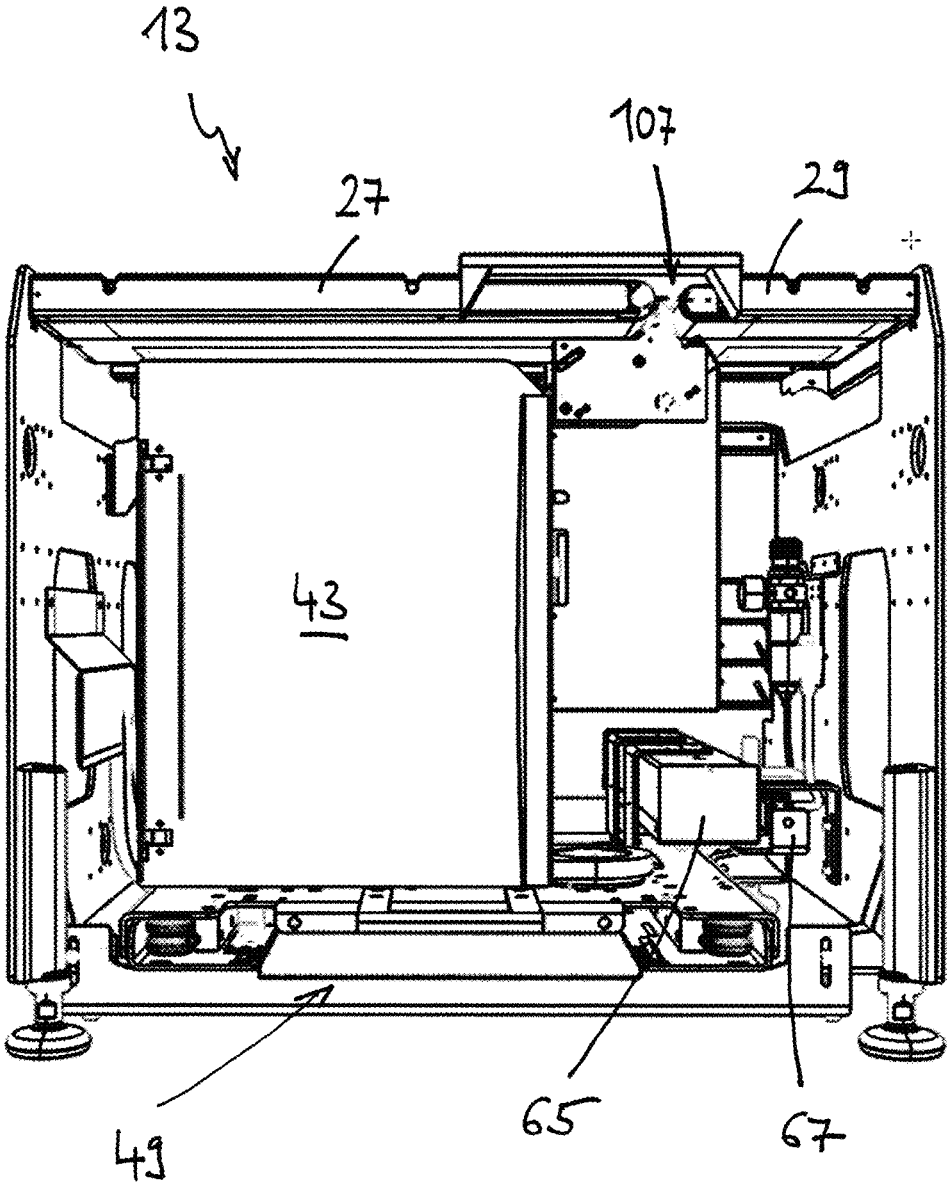
Figure 4A:
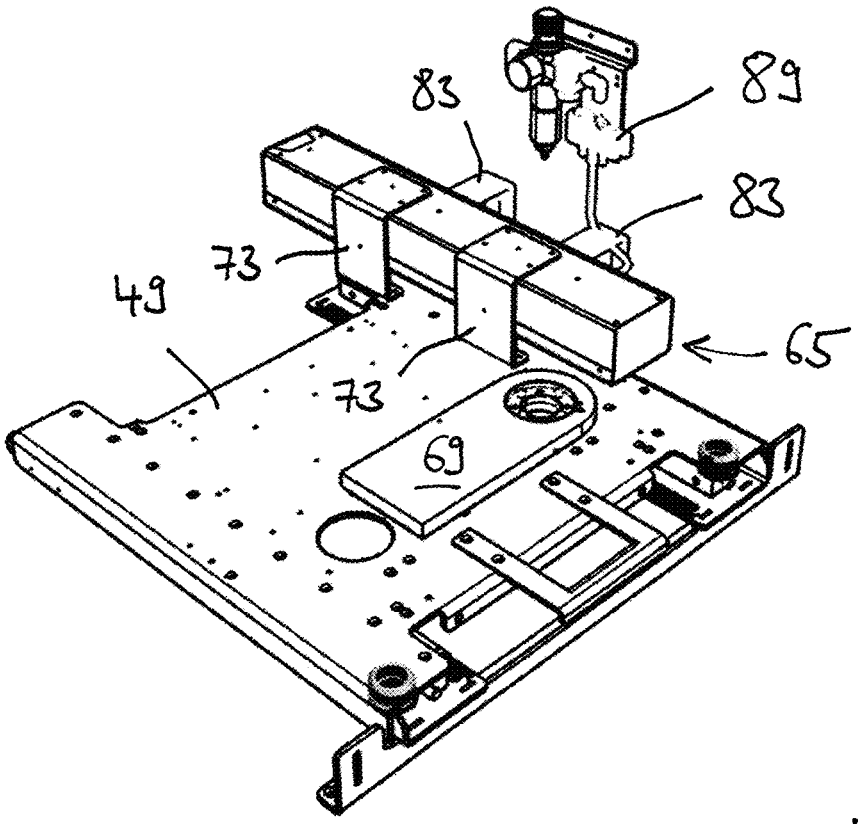
Figure 4B:
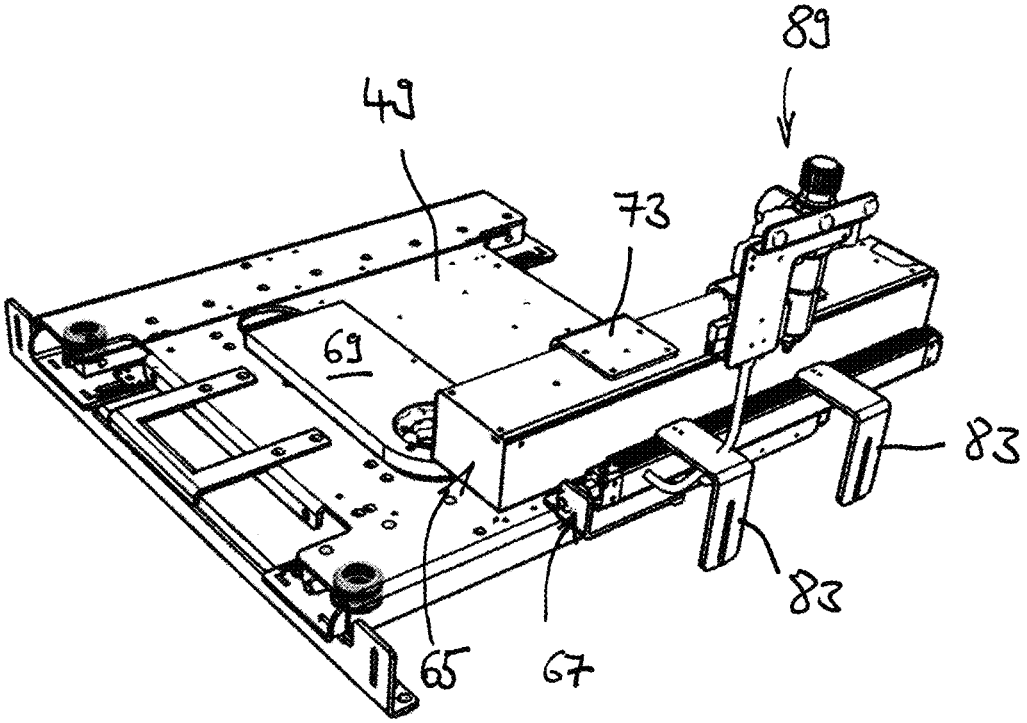
Figure 5:
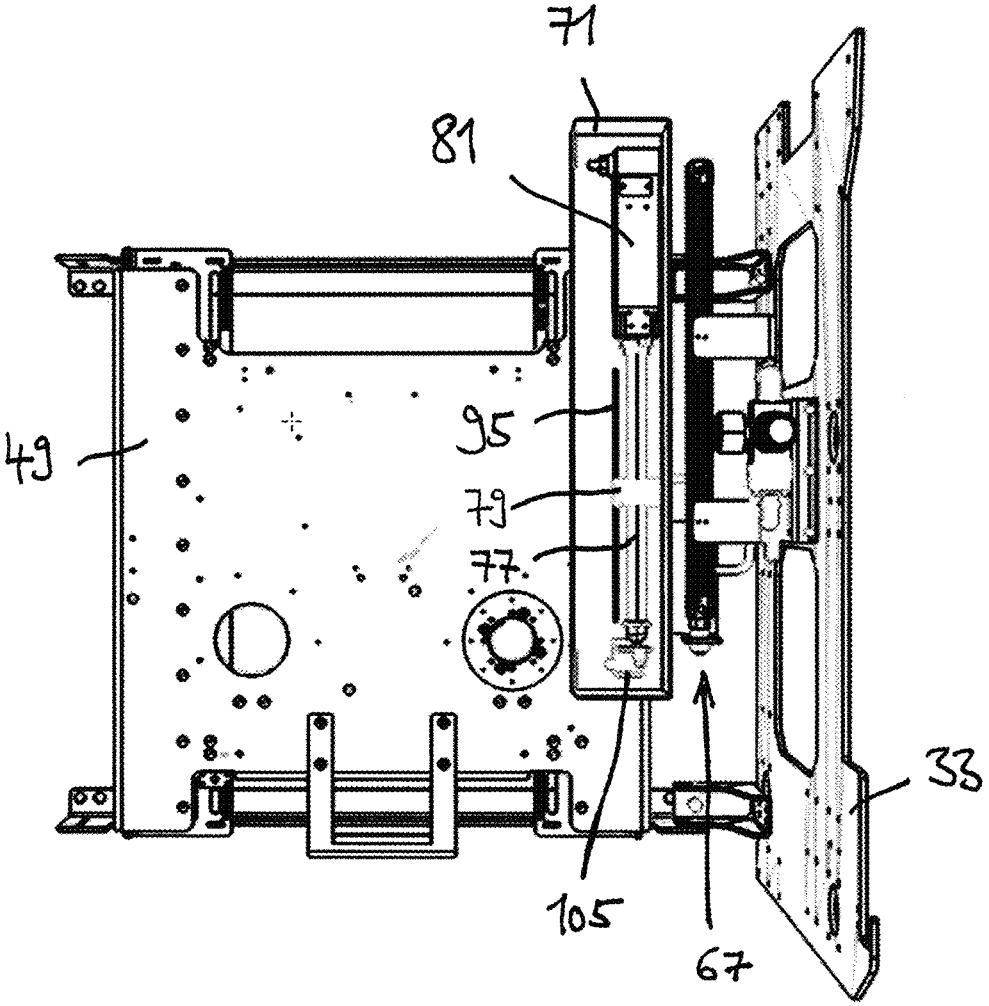
Figure 6A:
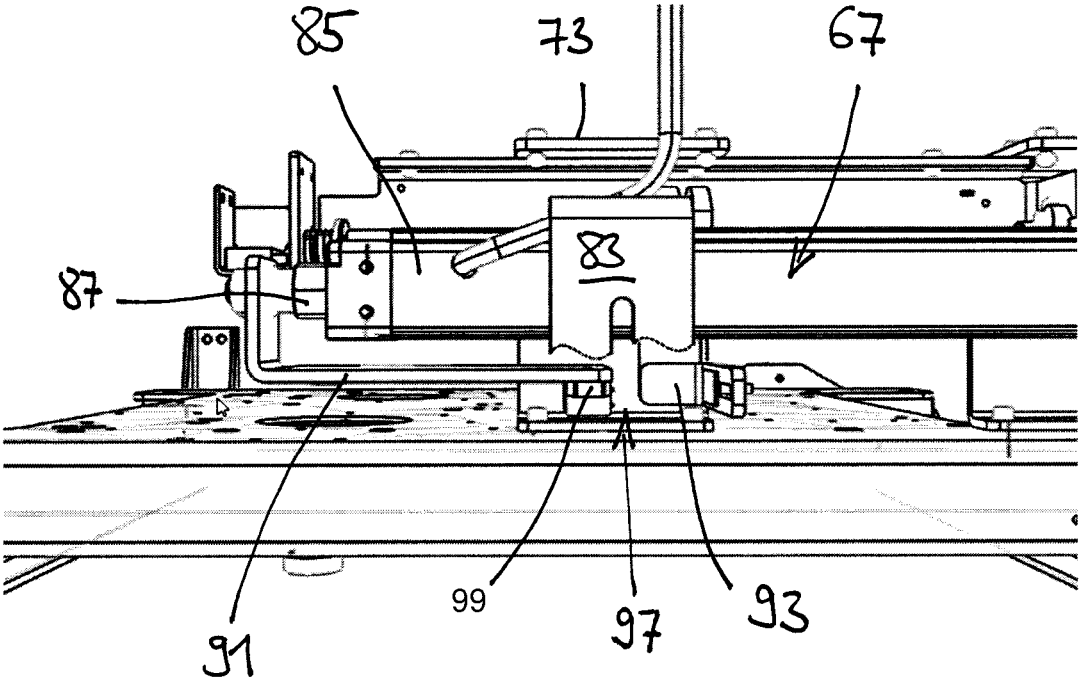
Figure 6B:
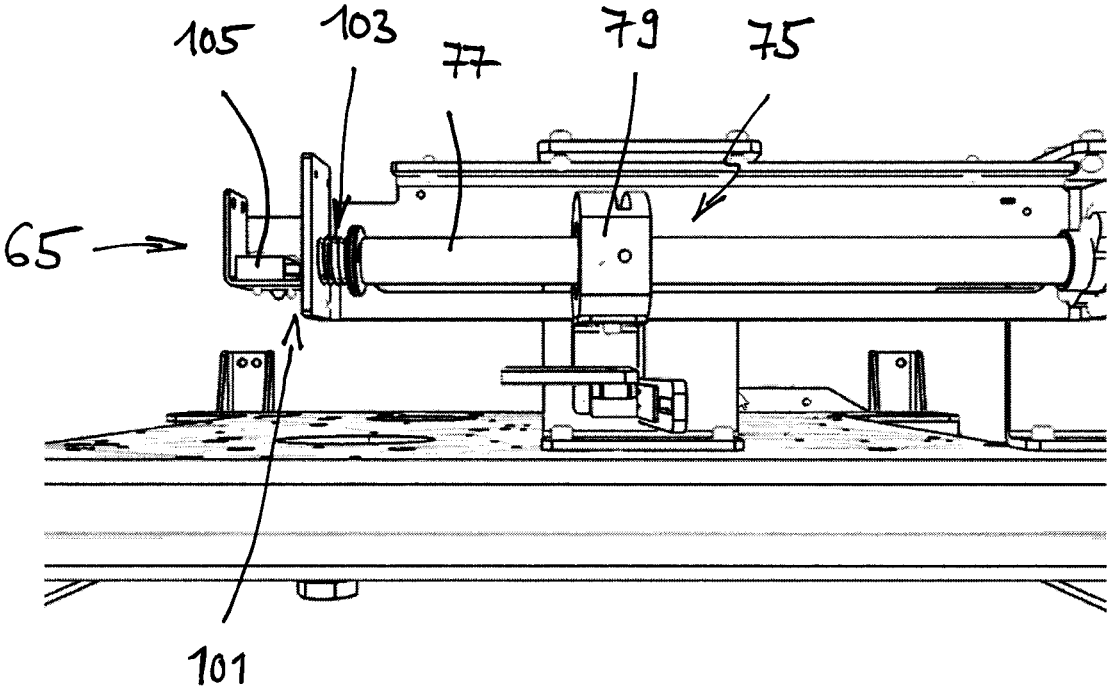

The invention will be described in the following by way of example with reference to the drawing. There are shown FIG. 1 a perspective view of a weighing conveying apparatus comprising a labeling apparatus having a pullout apparatus in accordance with the prior art;

FIG. 2 the pullout apparatus of FIG. 1 in a perspective view,

FIG. 3 a labeling apparatus in accordance with the invention that comprises a pullout apparatus having a pullout, having an electric motor drive, and having a pneumatic cylinder, and a labeler for the lower side of the packaging arranged on the pullout;

FIGS. 4*a-b* the pullout apparatus of FIG. 3 in two perspective views;

FIG. 5 the pullout apparatus of FIG. 3 in a view from above;

FIG. 6*a* a detail view of the electric motor drive and of the pneumatic cylinder, with housing parts of the electric motor drive having been omitted; and FIG. 6*b* the representation in accordance with FIG. 6, with the pneumatic cylinder additionally having been omitted.

The apparatus shown in FIG. 1 shows a weighing conveying apparatus 11 that is known from the initially named document and that comprises an infeed belt 15, a weighing belt 17, an outfeed belt 19, a metal detector 23, and a labeling apparatus 13 comprising a conveyor belt having two conveyor belt sections 27, 29. The weighing belt 17 is coupled to a load cell, not shown, that is arranged beneath the weighing belt 17 and that is adapted to determine the weight of a package moving over the weighing belt 17. The weighing belt 17 and the load cell form a weighing platform that can be configured as a control scale or checkweigher or as a price labeler. Sheet metal dirt guards 21 are provided at both sides of the three transport belts 15, 17, 19.

In normal operation of the weighing conveying apparatus 11, packages to be weighed are handed over from the infeed belt 15 to the weighing belt 17, are weighed there, and are transported on via an outfeed belt 19 to a transport belt of the metal detector 23. The packages are subsequently taken over by the labeling apparatus 13 and are provided with a label that was previously printed using the price labeler with the weight determined for the respective package by the load cell. The labeling apparatus 13 is accordingly a labeling apparatus including a printer. The metal detector 23 can also be omitted or a sorting device can, for example, also be provided instead of the metal detector 23 or in addition thereto. In the region of the labeling apparatus 13, in the view in accordance with FIG. 1, a switch cabinet 31 for the control of the weighing conveying apparatus 11 is provided at the rear side of a rack 25 of the weighing conveying apparatus 11.

The rack 25 comprises a plurality of side walls 33 that are fixedly connected to one another in the region of the conveyor belts 15 and 19, of the weighing belt 17, and of the metal detector 23, i.e. in the region of a weighing module and of a metal detector module of the rack 25, via a respective plurality of longitudinal members 37 formed as round tubes and extending in parallel with one another. The side walls 33 of the weighing module are each formed in two parts, with the two respective side wall parts being connected to one another via cross members 39 that are formed as square tubes and that are provided at the inner sides of the side wall parts. Two respective feet 35 that are vertically adjustable independently of one another are screwed to the side walls 33. An adjustment of the height of the rack 25 can be carried out by the feet 35.

The labeling apparatus 13 comprises a so-called top labeler 41, that is a labeler for the upper package side, that is arranged above the conveyor belt 27, 29 or the conveyor belt sections 27, 29 to provide packages transported on the conveyor belt 27, 29 with a label from above, i.e. on their upper sides. The labeling apparatus 13 furthermore comprises a so-called bottom labeler 43, i.e. a labeler for the lower package side, that is arranged beneath the conveyor belt 27, 29 or the conveyor belt sections 27, 29 within the rack 25 to provide packages transported on the conveyor belt 27, 29 with a label from below, i.e. on their lower sides. The respective labeler is dispensed for this purpose upwardly from the bottom labeler 43 through the gap formed between the conveyor belt section 27 and the conveyor belt section 29 and is applied to the packages.

To ensure a simple accessibility of the bottom labeler 43, for example for a change of the label roll or for servicing, a pullout apparatus 45 shown in detail in FIG. 2 is provided for the bottom labeler 43 to pull the bottom labeler 43 out of the less accessible operating position beneath the conveyor belt 27, 29. The bottom labeler 43 here additionally stands on a turntable 47 of the pullout apparatus 45. It is hereby possible to pivot the bottom labeler 43 about the vertical to further facilitate work, in particular service work, on the bottom labeler 43.

The pullout apparatus 45 comprises a plate-like pullout 49 that is supported in a linearly travelable manner between the one retracted end position such as is shown in FIGS. 1 and 2 and an extended end position, not shown, at a stationary pullout carrier 53 that is fixedly connected to the rack 25. The pullout carrier 53 has two L-shaped cross members 55 whose shorter limbs are each oriented in the vertical and whose longer limbs are each oriented in the horizontal. The two cross members 55 are arranged at both sides of the pullout apparatus 45. The pullout carrier 53 furthermore has two longitudinal members 57 by which the two cross members 55 are fixedly connected to one another.

The pullout guide 51 is formed as a roller guide. For this purpose, two respective rollers 59 are provided on each of the two cross members 55, are arranged behind one another in the traveling direction of the pullout 49, and of which only the respective front roller 59 is visible in FIG. 2. The rollers 59 are each formed in the manner of a cable pulley, i.e. their running surfaces are each centrally provided with a peripheral groove. The two rollers 59 of a respective cross member 55 cooperate with a respective guide rod 61 that is oriented in the direction of travel and that is respectively attached to the lower side of the pullout 49 via a respective web 63. The cooperation takes place here such that the respective guide rod 61 engages into the grooves of the two respective rollers 59 so that the guide rod 61 can roll off at the rollers 59 on the traveling of the pullout 49.

A labeling apparatus 13 in accordance with the invention is shown in FIG. 3 that is further developed with respect to the known labeling apparatus 13 in accordance with FIGS. 1 and 2 and whose pullout apparatus 45 is explained in more detail in FIGS. 4*a* to 6*b*, with the same reference numerals as in the preceding FIGS. 1 and 2 being used for the same parts.

With respect to the known pullout apparatus, the pullout apparatus 45 in accordance with the invention additionally has a motor-driven adjustment unit in the form of an electric motor drive 65 as well as a pneumatic cylinder 67 whose respective functions will be explained in more detail below. The bottom labeler 43 furthermore does not stand directly on the turntable 47, but rather on a pivot extension 69 that is in turn fastened to the turntable 47.

The electric motor drive 65 is provided to set the location of the retracted end position of the pullout 49. Since the location of the bottom labeler 43 relative to the conveyor belt 27, 29 or to the conveyor belt sections 27, 29 is also predefined by this location, the label position on the packages is ultimately hereby also predefined. The pneumatic cylinder 67 is in contrast provided to travel the pullout 49 between the retracted end position and the extended end position.

The electric motor drive 65 is arranged on the pullout 49 and comprises a threaded spindle 75, that has a threaded rod 77 and a spindle nut 79, and an electric motor 81 that drives the threaded spindle 75 or the threaded rod 77. The threaded spindle 75 and the electric motor 81 are arranged in a housing 71 of the electric motor drive 65 that is fastened to the pullout 49 via two sheet metal fasteners 73. If the spindle nut 79 is held in a fixed manner and if the electric motor is activated, the threaded rod 77 moves with the electric motor 81 and the housing 71 in the axial direction of the threaded rod 77 and thus the pullout 49 moves in the direction of travel. For this purpose, the threaded rod 77 is axially fixedly coupled to the housing 71 and thus to the pullout 49. The pullout 49 moves in the direction of retraction or extension depending on the direction of rotation of the electric motor 81. The pullout 49 can furthermore be traveled between the retracted end position and the extended end position by traveling the spindle nut 79 by means of the pneumatic cylinder 67.

The electric motor drive 65 is controlled by a control device, not shown, that can in particular be arranged in the switch cabinet 31. It can be achieved by the control device that the labels to be applied are affixed at a desired position, for example centrally, on the incoming packages. Respective dispensing positions are in particular stored in a database, not shown, for different labels and/or packages that differ from one another in their widths, i.e. in particular in their dimensions perpendicular to the direction of transport. With knowledge of which packages are to be provided with which labels, the control device can then select the corresponding dispensing position and can set the location of the pullout 49 accordingly.

The pneumatic cylinder 67 is fixedly fastened to the rear side wall 33 via two sheet metal fasteners 83. The pneumatic cylinder 67 comprises a housing 85 and a piston, not shown, which is axially movably arranged therein and to which an end of a piston rod 87 is fastened which projects out of the housing 85. The pneumatic cylinder 67 is configured in the embodiment shown as a singly acting cylinder that is operable with compressed air via a compressed air supply 89 so that the piston rod 87 can be moved to and fro in the axial direction. The piston rod 87 is axially fixedly coupled to the spindle nut 79 via a connection element 91 and an entrainer 93 that extends through a slit 95 that is formed at the lower side of the housing 71 of the electric motor drive 65 so that the pullout 49 can be traveled between the retracted end position and the extended end position by actuation of the pneumatic cylinder 67 as was already mentioned above.

A security against extension 97 is furthermore provided in the form of a releasable magnetic coupling by which the axially fixed coupling between the connection element 91, and the piston or the piston rod 87, on the one hand, and the entrainer 93, and ultimately the pullout 49, on the other hand, can be released on the extension of the pullout 49 from the retracted end position into the extended end position if the pullout 49 moves toward an operator. Injuries can hereby be avoided. For this purpose, the magnetic coupling 97 has a permanent magnet 99 that attracts the entrainer 93 and takes it along on the extension, with the magnetic attraction breaking down when the extension 49 impacts an obstacle. Alternatively or additionally, provision can also be made as a security device that the operating pressure of the pneumatic cylinder 67 is selected as comparatively small, e.g. 1.5 bar, so that only a comparatively small force is exerted by the pneumatic cylinder 67.

A security against retraction 101 is furthermore also provided to avoid a squeezing of and thus an injury to an operator on the retraction of the pullout 49. The security against retraction 101 comprises the threaded rod 77 being axially movably coupled to the electric motor 81 and the threaded rod 77 being able to actuate a safety switch 105 against the force of a helical spring 103 and through an opening in an inner wall of the housing 71. The piston rod 87 is withdrawn into the housing 85 of the pneumatic cylinder 67 to retract the pullout 49. The connection element 91 here presses against the entrainer 93 so that the pullout 49 is traveled into the retracted end position under the agency of the spindle nut 79, of the threaded rod 77, and of the housing 71. If the pullout 49 abuts an obstacle in so doing, the axial coupling between the threaded rod 77 and the housing 71 is released. In this process, the spindle nut 79 travels further inward, with the movement of the pullout 49 and thus of the housing 71, however, being blocked from which an axial movement of the threaded rod 77 in the direction of extension results, whereby the safety switch 105 is actuated so that the pneumatic cylinder 67 can be correspondingly deactivated.

REFERENCE NUMERAL LIST

11 weighing conveying apparatus
13 labeling apparatus
15 infeed belt
17 weighing belt
19 outfeed belt
21 sheet metal dirt guard
23 metal detector
25 rack
27 conveyor belt section
29 conveyor belt section
31 switch cabinet
33 side wall
35 foot
37 longitudinal member
39 cross member
41 top labeler
43 bottom labeler
45 pullout apparatus
47 turntable
49 pullout
51 pullout guide
53 pullout carrier
55 cross member
57 longitudinal member
59 roller
61 guide rod
63 web
65 electric motor drive
67 pneumatic cylinder
69 pivot extension
71 housing
73 sheet metal fastener
75 threaded spindle
77 threaded bar
79 spindle nut
81 electric motor
83 sheet metal fastener
85 housing
87 piston rod
89 compressed air supply
91 connection element
93 entrainer
95 slit
97 security against extension
99 permanent magnet
101 security against retraction
103 helical spring
105 safety switch
107 gap

The invention claimed is:

1. A labeling apparatus comprising:
a conveyor belt for transporting packages,
a labeler to apply labels to the packages from below, and
a pullout apparatus that comprises a pullout that is supported via a pullout guide at a stationary pullout carrier and that is linearly travelable relative thereto between a retracted end position and an extended end position, wherein the labeler is positioned on the pullout, wherein the pullout apparatus is configured such that a location of the retracted end position of the pullout is adjustable, and wherein the pullout apparatus comprises a motor-driven adjustment unit to set the location of the retracted end position of the pullout.

2. The labeling apparatus in accordance with claim 1, further comprising a control device that is configured to control the motor-driven adjustment unit of the pullout apparatus such that the location of the retracted end position of the pullout relative to the conveyor belt is set in dependence on a predefined dispensing position of the labels to be applied.

3. The labeling apparatus in accordance with claim 2, further comprising a storage device in which a plurality of dispensing positions for labels and/or packages of different dimensions are stored, with a control unit being adapted to select the predefined dispensing position from the stored dispensing positions.

4. The labeling apparatus in accordance with claim 1, wherein the motor-driven adjustment unit comprises a threaded spindle and an electric motor driving the threaded spindle.

5. The labeling apparatus in accordance with claim 4, wherein the threaded spindle comprises a threaded rod and a spindle nut.

6. The labeling apparatus in accordance with claim 5, wherein a traveling of the pullout between the retracted end position and the extended end position takes place on the basis of a corresponding traveling of the spindle nut.

7. The labeling apparatus in accordance with claim 5, wherein the pullout is axially fixedly coupled to the threaded rod such that an axial movement of the threaded rod and thus of the pullout takes place with a fixedly held the spindle nut fixedly held and with the electric motor activated.

8. The labeling apparatus in accordance with claim 7, wherein the pullout is axially fixedly coupled to the threaded rod via a housing of the motor-driven adjustment unit such that an axial movement of the threaded rod and thus of the pullout takes place with the spindle nut fixedly held and with the electric motor activated.

9. The labeling apparatus in accordance with claim 7, further comprising a security against retraction that releases the axially fixed coupling of the pullout to the threaded rod when a force acting on the pullout and acting against the retraction exceeds a predefined amount on an automated retraction from the extended position into the retracted position.

10. The labeling apparatus in accordance with claim 9, wherein the security against retraction comprises the threaded rod being rotationally fixedly coupled to the electric motor, and being axially movable, with the threaded rod actuating a safety switch against the force of a spring on an exceeding of the predefined amount.

11. The labeling apparatus in accordance with claim 1, wherein the pullout apparatus comprises a further drive to travel the pullout in an automated manner between the retracted end position and the extended end position.

12. The labeling apparatus in accordance with claim 11, wherein the further drive is formed as one of a pneumatic cylinder and a hydraulic cylinder.

13. The labeling apparatus in accordance with claim 12, wherein the further drive has a fixedly arranged housing and a piston arranged axially movably therein.

14. The labeling apparatus in accordance with claim 13, wherein an operating pressure of the pneumatic cylinder amounts to a maximum of 3 bar.

15. The labeling apparatus in accordance with claim 13, wherein a spindle nut of a threaded spindle of the motor-driven adjustment unit is axially fixedly coupled to the piston so that an axial movement of the motor-driven adjustment unit of the motor-driven adjustment unit and thus of the pullout takes place with the further drive activated.

16. The labeling apparatus in accordance with claim 15, further comprising a security against extension that releases the axially fixed coupling of the spindle nut to the piston when a force acting on the pullout and acting against the extension exceeds a predefined amount on an extension from the retracted end position into the extended end position.

17. The labeling apparatus in accordance with claim 15, further comprising a security against extension that releases the axially fixed coupling of the spindle nut to the piston when a force acting on the pullout and acting against the extension exceeds a predefined amount on the extension from the retracted end position into the extended end position on the basis of a corresponding traveling of the piston.

18. The labeling apparatus in accordance with claim 16, wherein the security against extension comprises the coupling of the spindle nut to the piston comprising a magnetic coupling between a magnet and an entrainer, with the magnetic coupling releasing on an exceeding of the predefined amount.

19. The labeling apparatus in accordance with claim 1, wherein the conveyor belt comprises two conveyor belt sections arranged behind one another and spaced apart from one another such that a gap through which the labels can be applied to the packages from below is formed between the two conveyor belt sections.

20. A weighing conveying apparatus comprising a first conveyor belt, a weighing belt, and a labeling apparatus, the labeling apparatus comprising:

a second conveyor belt for transporting packages, a labeler to apply labels to the packages from below, and a pullout apparatus that comprises a pullout that is supported via a pullout guide at a stationary pullout carrier and that is linearly travelable relative thereto between a retracted end position and an extended end position, wherein the labeler is positioned on the pullout, wherein the pullout apparatus is configured such that a location of the retracted end position of the pullout is adjustable, and wherein the pullout apparatus comprises a motor-driven adjustment unit to set the location of the retracted end position of the pullout.

* * * * *